United States Patent [19]

Koci

[11] Patent Number: 4,519,805

[45] Date of Patent: May 28, 1985

[54] VAT DYE AND SULFUR DYE COMPOSITIONS

[75] Inventor: Zdenek Koci, Binningen, Switzerland

[73] Assignee: Ciba Geigy Corporation, Ardsley, N.Y.

[21] Appl. No.: 335,428

[22] Filed: Dec. 29, 1981

[30] Foreign Application Priority Data

Dec. 30, 1980 [CH] Switzerland ..... 9644/80

[51] Int. Cl.[3] ..... C09B 49/00; C09B 57/00

[52] U.S. Cl. ..... 8/650; 8/610; 8/613; 8/652; 106/19

[58] Field of Search ..... 106/19; 8/610, 613, 8/650, 652

[56] References Cited

U.S. PATENT DOCUMENTS

| | | | |
|---|---|---|---|
| 1,803,219 | 4/1931 | Tagliani | 8/613 |
| 2,074,150 | 5/1937 | Kern | 8/607 |
| 2,256,806 | 9/1941 | Kern | 8/70 |
| 2,852,331 | 9/1958 | Youse | 8/613 |
| 2,960,381 | 11/1960 | Bashford | 8/83 |
| 3,201,190 | 8/1965 | Carmichael | 8/61 |
| 3,236,583 | 2/1966 | Hees | 8/55 |

FOREIGN PATENT DOCUMENTS

| | | |
|---|---|---|
| 354777 | 8/1931 | United Kingdom . |
| 1130908 | 10/1968 | United Kingdom . |

*Primary Examiner*—Paul Lieberman
*Assistant Examiner*—Amelia B. Yarbrough
*Attorney, Agent, or Firm*—Edward McC. Roberts; Kevin T. Mansfield

[57] ABSTRACT

Specific vatting accelerators according to claims 1 and 2 are described. These can be added to a vat dye or sulfur dye composition, or to a dye bath or printing paste containing a vat dye or sulfur dye, by virtue of which an improvement of dye yield, particularly on cellulose materials, is obtained.

7 Claims, No Drawings

VAT DYE AND SULFUR DYE COMPOSITIONS

The invention relates to specific vatting accelerators which, when added to a composition containing a vat or sulfur dye, or to a dye bath or a printing paste containing such dyes, serve to improve the dye yield on materials treated therewith, particularly materials containing cellulose.

There are known numerous processes in which the dye yield when cellulose materials are being dyed or printed with vat or sulfur dyes is improved by the addition of specific vatting accelerators, usually oxidising agents. A comprehensive survey is to be found for example in the German Offenlegungsschrift No. 1,469,670. In this connection is described in the German Offenlegungsschrift No. 2,252,944 the use of quinoid compounds, such as benzoquinone, naphthoquinone and anthraquinone, as well as derivatives thereof. For the same purpose is also known, from the German Patent Specification No. 1,239,269 and French Patent Specification Nos. 1,314,630 and 1,353,730, the use of inorganic and organic heavy metal compounds, and there is recommended in the G.B. Patent Specification No. 1,130,908 the use of aliphatic and aromatic-aliphatic primary diamines or polyamines.

Only a limited number of substances from the stated classes of compounds are however suitable for effecting the necessary good and rapid distribution of the vat or sulfur dyes in the dye liquors, printing pastes and dye compositions. These substances are moreover often difficult to produce or obtain. Furthermore, the majority of these known compounds have disadvantages also in other respects, such as a low degree of effectiveness in certain cases where different vat dyes or dyeing processes are concerned (for example the action of the compounds when used in the pad-steam dyeing process may be poor compared with their action in the printing process), they are expensive and some have dark inherent colours, such as those of many quinone compounds, as well as deviations in shade, occurring for example with the use of anthraquinone. With regard to the heavy metal compounds, these are ecologically less suitable, and polyamines are effective only at high concentrations in the dye bath.

It was therefore the object of the present invention to find vatting accelerators which would not have the above-mentioned disadvantages, and which would, in the case of the present-day, rapidly functioning dyeing and printing processes with vat dyes and sulfur dyes, increase the rate of reduction of the dyes and simultaneously the dye yield of the dyeings from the dye liquor or printing paste.

The solution of this problem is the application of specific vatting accelerators or mixtures thereof, as described in the following, for the purpose of improving the vatting property of vat dyes and sulfur dyes in the dyeing or printing of cellulose-containing textile materials, especially cotton or mixed fabrics of cotton and polyester. These specific vatting accelerators are in themselves known as antioxidants; they have an excellent level of effectiveness, are favourable in price, and do not have the aforementioned disadvantages. They can be present either in a composition containing a vat dye or a sulfur dye, or they can be added to the dye bath or reducing bath, or to the printing paste.

The invention thus relates to a solid or liquid vat dye or sulfur dye composition having a content of 0.1 to 20 percent by weight, relative to the dye, of a vatting accelerator containing at least one aromatic hydroxyl group and/or a secondary or tertiary amino group, a —CONHOH— group, a —CS— or an >S=O grouping or a thiamide group. These vatting accelerators are in particular the following compounds:

(A) compounds of the formula

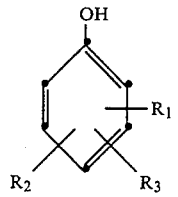

wherein $R_1$, $R_2$ and $R_3$ independently of one another are: $C_1$–$C_{12}$-alkyl, $C_3$–$C_{12}$-alkenyl, —$CH_2OH$, hydrogen, halogen, OH, $C_1$–$C_4$-alkoxy or unsubstituted or substituted phenyl, benzyl or phenethyl, or they are each cyclohexyl, $SO_3H$, COOH, $NO_2$, $CONH_2$ or the group

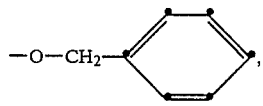

with the proviso that $R_1$, $R_2$ and $R_3$ are not simultaneously each hydrogen, and also that, if one of the radicals $R_1$, $R_2$ and $R_3$ is —OH or —$CH_3$, at most one of the remaining two radicals is hydrogen.

As a $C_1$–$C_{12}$-alkyl group, $R_1$, $R_2$ and $R_3$ can be straight-chain or branched-chain. They are for example each the methyl group, ethyl group, n-propyl group, iso-propyl group, the n-, sec- or tert-butyl group, the n-, sec- or tert-amyl group, the n-, sec- or tert-hexyl group, the n-, sec- or tert-octyl group or the n-, sec- or tert-dodecyl group. When they are each an alkenyl group ($C_3$–$C_{12}$), it can be for example n-propenyl or the allyl group. Where $R_1$, $R_2$ and $R_3$ are halogen, they are each in particular fluorine, chlorine or bromine. $R_1$, $R_2$ and $R_3$ as a $C_1$–$C_4$-alkoxy group are each for example the methoxy, ethoxy, n- or iso-propoxy group or n- or iso-butoxy group. Substituents in the phenyl, benzyl or phenethyl group are for example: halogen, such as fluorine, chlorine or bromine, the OH group, $C_1$–$C_{12}$-alkyl, preferably $C_1$–$C_4$-alkyl (branched-chain or straight-chain) or $C_1$–$C_4$-alkoxy (branched-chain or straight-chain).

Type (A) compounds are for example the following:
3,5-di-tert-butyl-pyrocatechin,
hydroquinone-monobenzyl ether,
5-methyl-resorcin,
4-cyclohexyl-resorcin,
2,5-di-(tert-amyl)-hydroquinone,
tert-butyl-hydroquinone,
4-hydroxymethyl-2,6-di-(tert-butyl)-phenol, and especially
4-chloro-m-cresol,
2,6-di-tert-butyl-p-cresol,
2,5-di-tert-butyl-hydroquinone, and in particular
2-benzyl-4-chlorophenol.

The said compounds of the type (A) are known, and can be produced by known methods.

(B) A further class of compounds are those of the compound class (A) which are linked by way of a bridge member $R_3'$, instead of the substituent $R_3$, to an organic radical. They are compounds of the formula

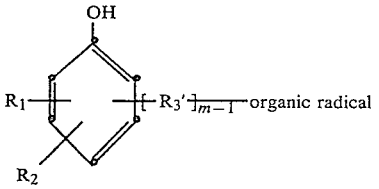

wherein $R_1$ and $R_2$ have the meanings defined above, m is a number 1 or 2, and $R_3'$ is any bridge member, for example the radical of an inorganic or organic acid, or the radical of an aldehyde, of a styrene or of an olefin, and preferably a

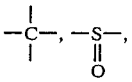

—S—, —S—S—, —O—, —CH=CH—, or

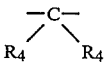

group, wherein each $R_4$ independently of the other is hydrogen or $C_1$–$C_4$-alkyl.

Of particular importance are compounds of the formula

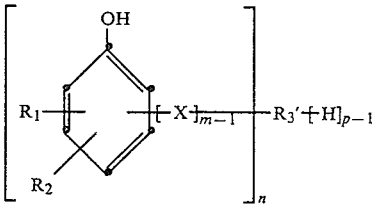

wherein $R_1$, $R_2$ and $R_3'$ have the meanings defined above, and X is an aliphatic bridge member, preferably $—(CH_2)_2—COO—CH_2$, m is a number 1 or 2, n is a number 1 to 4, and p is a number 1 to 3.

This group includes the partial or full esters of compounds of the type (A) with inorganic and organic acids, for example with phosphorous acid, or corresponding mono-, di- or triphosphites, or said esters with isocyanuric acid. A compound of this type is for example tris-(3,5-di-tert-butyl-4-hydroxyphenyl)-phosphite.

The group (B) includes also those compounds which are formed by condensation of compounds of the type (A) with for example aldehydes, such as formaldehyde or crotonaldehyde, and also reaction products of compounds (A) with for example styrene and derivatives thereof or with olefins.

Further compounds of the type (B) which may be mentioned are for example:

2,2'-methylene-bis(4-methyl-6-tert-butyl-phenol),
2,2'-thio-bis(4-methyl-6-tert-butyl-phenol),
thio-bis(di-sec-amyl-phenol), and particularly
4,4'-methylene-bis(2,6-di-tert-butyl-phenol), and preferably
tetrakis[methylene-3-(3',5'-di-tert-butyl-4'-hydroxyphenyl)-propionate]-methane of the formula

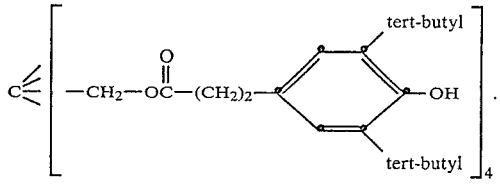

Further examples of the compounds of class (B) in which m=1 are compounds of the formula

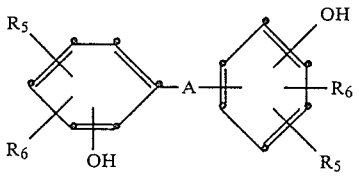

wherein A is the direct bond or a bivalent bridge member of the formula

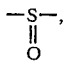

—S—, —S—S—, —CH=CH— or

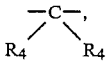

in which each $R_4$ independently of the other is hydrogen or $C_1$–$C_4$-alkyl, and $R_5$ and $R_6$ each independently of the other: are $C_1$–$C_{12}$-alkyl, $C_3$–$C_{12}$-alkenyl, halogen, $C_1$–$C_4$-alkoxy, unsubstituted or substituted phenyl, or they are each cyclohexyl, benzyl, phenethyl, hydrogen, $SO_3H$, COOH, $NO_2$ or $CONH_2$.

When $R_4$ is a $C_1$–$C_4$-alkyl group, it is for example the methyl, ethyl, n- or iso-propyl group, or the n-, sec- or tert-butyl group. If $R_5$ and/or $R_6$ are a $C_1$–$C_{12}$-alkyl group, this is for example a straight-chain or branched-chain alkyl group, such as the methyl, ethyl, n- or iso-propyl group, the n-, sec- or tert-butyl group, n- or iso-hexyl group, n- or iso-octyl group or the n- or iso-dodecyl group. Where $R_5$ and/or $R_6$ are a $C_3$–$C_{12}$-alkenyl group, this is for example the allyl group. If $R_5$ and/or $R_6$ are halogen, this is fluorine, chlorine or bromine. When $R_5$ and/or $R_6$ are a $C_1$–$C_4$-alkoxy group, this is for example the methoxy, ethoxy, n- or iso-propoxy group and n- or iso-butoxy group. And when $R_5$ and/or $R_6$ are a substituted phenyl group, substituents are for example: halogen, such as fluorine, chlorine or bromine, the OH group, a $C_1$–$C_4$-alkoxy group (branched-chain or straight-chain) or a $C_1$–$C_{12}$-alkyl group (branched-chain or straight-chain). The following may be mentioned for example:

4,4'-methylene-bis(phenol),
4,4'-ethylidene-bis(phenol),
4,4'-thio-bis(phenol),
4,4'-thionyl-bis(phenol),
4,4'-dithio-bis(phenol),
4,4'-dihydroxystilbene,
4,4'-biphenyldiol, and particularly 4,4'-isopropylidene-bis(phenol) and
2,2'-methylene-bis(4-chlorophenol).

Preferred compounds of the classes (A) and ( B) are those compounds which contain a sterically hindered phenol group, especially those wherein the o-position with respect to the OH group is occupied by a tertiary alkyl group.

The compounds listed under (B) are known and can be produced by known methods.

(C) Compounds of the formula

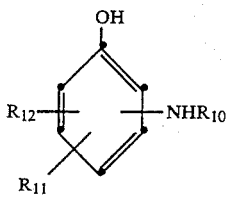

wherein $R_{10}$ is hydrogen or a straight-chain or branched-chain acyl group ($C_1$–$C_{18}$), $R_{11}$ is hydrogen, $C_1$–$C_4$-alkyl, COOH, OH, $C_1$–$C_3$-alkoxy, $CONH_2$ or $SO_3H$, and $R_{12}$ is hydrogen, OH, $C_1$–$C_{12}$-alkyl, COOH, $NO_2$, $SO_3H$, unsubstituted or substituted phenyl, or it is cyclohexyl, benzyl or phenethyl.

When $R_{11}$ is a $C_1$–$C_4$-alkyl group or a $C_1$–$C_3$-alkoxy group, this can be straight-chain or branched-chain.

Where $R_{12}$ is a $C_1$–$C_{12}$-alkyl group, this can be straight-chain or branched-chain; examples which are mentioned are: the methyl, ethyl, n- or iso-hexyl group and the n- or iso-octyl group. Substituents for phenyl are for example: halogen, such as fluorine, chlorine or bromine, the $NH_2$ group and the OH group.

The compounds mentioned under (C) are known and can be produced by known methods. Examples of these compounds are:
o-aminophenol,
m-aminophenol, and in particular
2-aminophenol-sulfonic acid, and
N-pelargonyl-p-aminophenol.

(D) Compounds of the formula

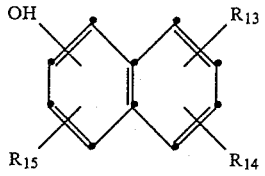

wherein $R_{13}$ is the OH or $NH_2$ group, and $R_{14}$ and $R_{15}$ independently of one another are each H or $SO_3H$. It is a case here on the one hand of dihydroxy-naphthalenes and on the other hand hydroxyamino-naphthalenes, where the two OH groups and the OH and $NH_2$ groups, respectively, are in the 1,6-, 1,8-, 2,5- and 2,7-positions.

The compounds are known and can be produced by known methods. The following are mentioned for example:
1,8-dihydroxynaphthalene,
2-amino-7-hydroxynaphthalene,
2,7-dihydroxynaphthalene, and especially
1,8-dihydroxynaphthalene-3,5-disulfonic acid.

(E) Compounds of the formula

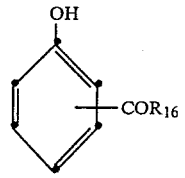

wherein $R_{16}$ is a straight-chain or branched-chain $C_1$–$C_4$-alkyl group, such as the methyl, ethyl, n- or iso-propyl group or n-, sec- or tert-butyl group. These compounds are known and can be produced by known methods. A preferred compound of this class is 4-hydroxy-acetophenone.

(F) Compounds of the formula $R_{17}$—CONHOH wherein $R_{17}$ has the following meanings: $C_1$–$C_{18}$-alkyl (straight-chain or branched-chain, such as methyl, tert-butyl or dodecyl); unsubstituted phenyl; phenyl substituted for example by halogen (fluorine, chlorine or bromine); cyclohexyl, benzyl or phenethyl. They are known compounds, the most interesting representative of which is benzohydroxamic acid.

(G) Compounds of the formula (a) or (b)

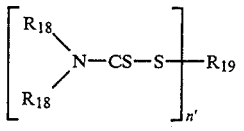

(a)

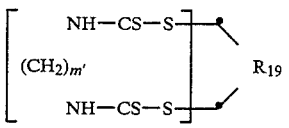

(b)

wherein each $R_{18}$ independently of the other is a straight-chain or branched-chain $C_1$–$C_{12}$-alkyl group, phenyl or benzyl, or both $R_{18}$'s can be constituents of an alkylene ring with $C_2$–$C_5$, m' is a number from 2–5, n' is the number 1 or 2, and $R_{19}$ is any monovalent or bivalent cation, particularly Na, K, $NH_4$ or Zn and Ca. These are for example the known salts of dialkyldithiocarbamic acid. There are mentioned for example the sodium salts of dimethyldithiocarbamate, dibutyldithiocarbamate, the sodium salt of ethylene-bis(dithiocarbamate), the zinc salt of pentamethylenedithiocarbamate and, in particular, the sodium salt of diethyldithiocarbamate.

(H) Compounds of the formula

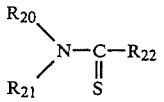

wherein $R_{20}$ and $R_{21}$ independently of one another are: hydrogen, $C_1$–$C_{12}$-alkyl, unsubstituted or substituted phenyl, benzyl or phenethyl, or cyclohexyl, and $R_{22}$ is the $NH_2$ group, $C_1$–$C_4$-alkyl, phenyl or

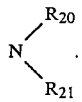

Substitutents for phenyl benzyl and phenethyl according to $R_{20}$ and $R_{21}$ are especially: OH, $NH_2$ or halogen, such as fluorine, chlorine or bromine. It is a case here of known thioamides, the most interesting representatives of which in this connection are thioacetamide, N,N'-dimethylthiourea and especially thiourea.

(I) Compounds of the formula

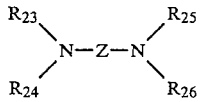

or

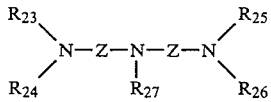

wherein each Z independently of the other is a bridge member of the formula

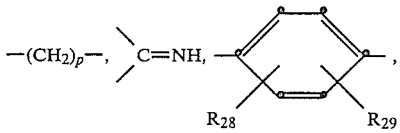

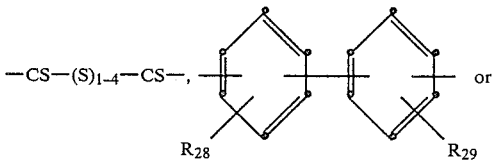

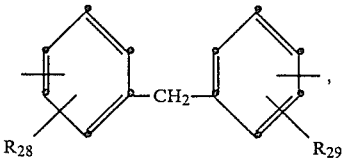

p is a number from 2–6, $R_{28}$ and $R_{29}$ independently of one anoher are each hydrogen, $C_1$–$C_6$-alkyl (straight-chain or branched-chain) or $C_1$–$C_3$-alkoxy (straight-chain or branched-chain), $R_{23}$, $R_{24}$, $R_{25}$ and $R_{27}$ independently of one another are each hydrogen, $C_1$–$C_{12}$-alkyl (straight-chain or branched-chain), $C_1$–$C_{12}$-hydroxyalkyl, unsubstituted or substituted phenyl, or cyclohexyl, $\alpha$- or $\beta$-naphthyl or benzyl, and $R_{26}$ is $C_1$–$C_{12}$-alkyl (straight-chain or branched-chain) or unsubstituted or substituted phenyl, or $\alpha$- or $\beta$-naphthyl, cyclohexyl or benzyl, $R_{23}$ and $R_{24}$ or $R_{25}$ and $R_{26}$ not simultaneously being hydrogen, with the proviso that, if Z is —$(CH_2)$p—, $R_{23}$, $R_{24}$, $R_{25}$ and $R_{27}$ are not $C_1$–$C_{12}$-hydroxyalkyl. Substituents for phenyl according to the symbols $R_{23}$, $R_{24}$, $R_{25}$, $R_{26}$ and $R_{27}$ being in particular: OH, halogen, (fluorine, chlorine or bromine), $NH_2$ and $C_1$–$C_4$-alkyl.

The compounds are all known and can be produced by known methods. The compounds are for example:
N,N'-diphenyl-p-phenylenediamine,
N,N'-N,N'-tetramethylguanidine,
pentamethyldiethylenetriamine,
di-o-tolylethylenediamine,
tetramethylthiuram disulfide, and
N,N'-diphenylethylenediamine.

(K) Compounds of the formula

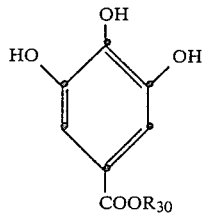

wherein $R_{30}$ is a straight-chain or branched-chain $C_1$–$C_{12}$-alkyl group, such as the methyl, ethyl, n- or iso-propyl, n- or iso-hexyl or n- or iso-octyl group.

The compounds here are the known gallic acid esters, the most interesting representatives of which in this connection are: n-propyl gallate and n-octyl gallate.

(L) Compounds of the formula

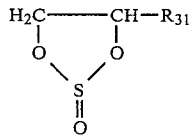

wherein $R_{31}$ is hydrogen, $CH_2OH$ or the $C_1$–$C_2$-alkyl group. A representative of this class is for example propylene glycol sulfite.

All the compounds listed under (A) to (L) are characterised by ease of preparation synthetically and by good dispersibility in the dye compositions, dye baths and printing pastes. The stated compounds have to be water-soluble and/or soluble in an alkaline reducing bath (pH≧12). If the compounds do not meet these requirements with regard to solubility, it is advantageous to grind them prior to their use, for example to grind them with an anionic dispersing agent to a particle size of $<5\mu$, especially about $1\mu$. This is effected generally by mixing the vatting accelerator, or a mixture thereof, with a dispersing agent, for example a naphthalenesulfonic acid/formaldehyde condensation product, for example by wet grinding them together in a corundum disc mill, ball mill, agitator mill, sand mill or some other grinding apparatus, optionally with subsequent drying of the mixture, for example in a spray dryer.

The said vatting accelerators are used, in the dye compositions, in amounts of 0.1 to 20 percent by weight, particularly between 0.5 and 10 percent by weight, relative to the amount of dye.

Preferred compounds are compounds according to the groups D, F to H, K and L, and especially phenols and amines according to groups A, B, C and I.

Besides containing the stated vatting accelerators, the dye compositions of the invention contain anionic dispersing agents or possibly nonionic fillers, preferably in amounts of 0.5 to 80 percent by weight. Dispersing agents of this type which are used are in particular those such as are described in the German Offenlegungsschrift No. 2,816,539.

Suitable vat dyes and sulfur dyes are for example: indanthrones, flavanthrones, pyranthrones, violanthrones, isoviolanthrones, benzanthrones, imides of perylenetetracarboxylic acid substituted on the nitrogen atom, acridones, anthraquinone oxazoles, anthraquinone thiazoles and compounds which are derived in particular from anthraquinone.

Further additives which can be contained in the dye compositions are those customarily used in dye preparations, such as humectants, anti-foaming agents, preservatives, wetting agents, levelling agents, thickeners, and so forth.

The addition of the said vatting accelerators (A) to (L) or mixtures thereof can be made according to the invention also directly to the dye bath, to the chemical bath or to the printing paste. The stated vatting accelerator is used in amounts of 0.01–5 g/l of dye bath or of chemical padding liquor, and 0.01–5 g/kg of printing paste. The preferred quantity range is between 0.05 and 1 g/l of dye bath or of chemical padding liquor, and between 0.05 and 1 g/kg of printing paste.

The dye baths and printing pastes moreover contain, besides the dye, also reducing agents, particularly sodium dithionite, sodium formaldehyde sulfoxylate or thiourea dioxide, and the alkaline range of the medium is adjusted in particular with NaOH or KOH.

Suitable dyeing and printing processes, in which by virtue of the addition according to the invention to the stated vatting accelerators an improvement in dye yield of about 7 to 10% or more is obtained, are the usual processes applicable for dyeing and printing with vat dyes and sulfur dyes, particularly for dyeing and printing cotton and cotton/polyester mixed fabrics. These vatting accelerators can be used in the exhaust process, in the printing process and especially in the continuous process. The result of the addition of vatting accelerators is that less dye has to be used, a feature which is an advantageous cost factor.

Dyeing processes which may be mentioned are for example: exhaust process in the jig, in the winch vat and in the jet-dyeing machine, the pad-jig process, the standfast process, the semi-pigmenting process, the pad-fixing process, for example the single-bath-pad-steam process, the pad-roll process, the pad-roll process with intermediate drying, the moist-steam process and particularly the pad-steam process. Printing processes to be mentioned are for example: single-phase and two-phase developing processes.

The Examples which follow further illustrate the invention without limiting its scope. 'Parts' denote parts by weight, and temperature values are in degrees Centigrade.

EXAMPLE 1

Pre-scoured and bleached cotton fabric is dyed in a pad-steam plant. The fabric is padded in a padding machine (squeezing effect 70%) with a padding liquor containing 40 parts of the liquid commercial form of the dye C.I. Vat Blue 18 (Colour Index No. 59815) and
960 parts of water;

the fabric is then dried at 100°, and is subsequently padded in a second padding machine with a liquor of the following composition (squeezing effect 80%):

60 parts of concentrated NaOH 36°Be',
50 parts of sodium dithionite,
25 parts of calcined sodium sulfate,
1.5 parts of a 30% aqueous dispersion of tetrakis-[methylene-3-(3',5'-di-tert-butyl-4'-hydroxyphenyl)-propionate]-methane (mean fineness 1μ), and
863.5 parts of water.

The cotton fabric is afterwards steamed in a steamer for 30 seconds at 100°. It is then rinsed in the customary manner, oxidised for 15 minutes at 50° with 3 ml/l of 30% $H_2O_2$, rinsed, and soaped for 15 minutes at boiling temperature with 2 g of an anionic detergent per liter and 1 g of calc. sodium carbonate per liter. There is thus obtained a blue dyeing which is more deeply coloured than a comparative dyeing made without the addition of the 30% aqueous dispersion of tetrakis-[methylene-3-(3',5'-di-tert-butyl-4'-hydroxyphenyl)-propionate]-methane.

When there is used as the vatting accelerator, instead of 1.5 parts of the 30% aqueous dispersion of tetrakis[-methylene-3-(3',5'-di-tert-butyl-4'-hydroxyphenyl)propionate]-methane, one of the following products in the amount given:

0.5 part of benzohydroxamic acid,
0.5 part of 4,4'-isopropylidine-bis(phenol),
0.5 part of 2-benzyl-4-chlorophenol,
0.5 part of 4,4'-methylene-bis(2,6-di-tert-butyl-phenol),
0.5 part of 2,6-di-tert-butyl-p-cresol,
0.5 part of the sodium salt of 2-aminophenol-4-sulfonic acid,
0.5 part of n-propyl gallate, or
2 parts of thiourea, the procedure otherwise being the same, there are likewise obtained blue dyeings which are more deeply coloured than the comparative dyeing without the vatting accelerator.

EXAMPLE 2

Pre-scoured cotton fabric is padded in the pad-steam process with a dyeing liquor containing 50 parts of the liquid commercial form of the dye C.I. Vat Yellow 2 (Colour Index No. 67300) and
950 parts of water, and, after drying, it is then padded with a liquor of the following composition:

60 parts of concentrated NaOH 36°Be',
50 parts of sodium dithionite,
25 parts of calcined sodium sulfate,
0.5 part of propylene glycol sulfite, and
864.5 parts of water.

The fabric is subsequently steamed at 100° for 30 seconds and afterwards finished in the manner described in Example 1. The result is a yellow dyeing which is far more deeply coloured than a comparative dyeing made without propylene glycol sulfite.

There are likewise obtained yellow dyeings, more deeply coloured than analogous dyeings made without the addition of a vatting accelerator, by using, instead of 0.5 part of propylene glycol sulfite, 0.5 part of any one of the following products:

4,4'-isopropylidene-bis(phenol),
2,2'-methylene-bis(4-chlorophenol),
thioacetamide, or
2 parts of thiourea.

EXAMPLE 3

A printing paste of the following composition:

70 parts of the liquid commercial form of the dye C.I. Vat Green 1 (Colour Index No. 59825), 60 parts of a thickener,
120 parts of potassium carbonate,
100 parts of the sodium salt of hydroxymethanesulfonic acid,
70 parts of glycerin,
2 parts of a 30% aqueous dispersion of tetrakis-[methylene-3-(3',5'-di-tert-butyl-4'-hydroxyphenyl)propionate]-methane, and
578 parts of water,
is printed onto a cotton fabric by means of a screenprinting machine. The fabric is subsequently steamed at 100° for 8 minutes, and then treated in the manner described in Example 1.

The result is a green dyeing which is more deeply coloured compared with a printing made without the 2 parts of the 30% aqueous dispersion of tetrakis-[methylene-3-(3',5'-di-tert-butyl-4'-hydroxyphenyl)-propionate]-methane.

A more deeply coloured dyeing is also obtained by adding, in place of the 2 parts of the 30% aqueous dispersion of tetrakis-[methylene-3-(3',5'-di-tert-butyl-4'-hydroxyphenyl)propionate]-methane, any one of the following products in the amount shown:

0.5 part of 2-benzyl-4-chlorophenol,
0.5 part of 4-chloro-m-cresol,
0.5 part of propylene glycol sulfite, or
4 parts of pentamethyldiethylentriamine.

EXAMPLE 4

97.5 parts of the solid commercial form of the dye Vat Brown 3 (Colour Index No. 69015), and
2.5 parts of diethyldithiocarbamate powder are mixed dry. From the dye composition thus obtained is prepared a dye liquor for the pad-steam process:
30 parts of the dye composition and
970 parts of water.
Scoured viscose rayon fabric is padded with this dye liquor, dried and further padded with a liquor consisting of:
60 parts of concentrated NaOH 36°Be',
50 parts of sodium dithionite,
25 parts of calcined sodium sulfate, and
865 parts of water.
After about 30 seconds' steaming at 100°, the fabric is treated in the manner described in Example 1.

The result is a brown dyeing which is more deeply coloured than a comparative dyeing with the same amount of dye but without the addition of diethyldithiocarbamate powder.

EXAMPLE 5

98.5 parts of the dye Vat Black 25 (Colour Index No. 69525) in the liquid commercial form, and
1.5 parts of propylene glycol sulfite are mixed together and homogenised. There is then prepared with this dye composition a dye liquor for a pad-steam dyeing:
50 parts of the dye composition, and
950 parts of water.
Scoured cotton fabric is padded with this dye liquor, and is then treated in the manner described in Example 4 for obtaining the finished dyeing.

The olive-green dyeing obtained is more deeply coloured than a comparative dyeing made without the addition of propylene glycol sulfite.

EXAMPLE 6

Scoured cotton fabric is padded in the pad-steam process with a dye liquor containing
50 parts of the liquid commercial form of the dye Vat Blue 6 (Colour Index No. 69825), and
950 parts of water;
the treated fabric is then dried, and further padded with a liquor of the following composition:
70 parts of concentrated NaOH 36°Be',
50 parts of sodium dithionite,
0.5 part of 2-benzyl-4-chlorophenol, and
879.5 parts of water.
After about 30 seconds' steaming at 100°, the fabric is further treated in the manner described in Example 1. The result is a blue dyeing which is much more deeply coloured than a comparative dyeing made without the addition of 4-hydroxyacetophenone.

There are also obtained blue dyeings more deeply coloured than a dyeing made without the accelerator by using, in place of 0.5 part of 4-hydroxyacetophenone, any one of the following products in the respective amount given:

0.5 part of 2,6-di-tert-butyl-p-cresol,
1.5 parts of a 30% liquid dispersion of 2,5-di-tert-butylhydroquinone,
0.5 part of 2-aminophenol-4-sulfonic acid,
0.5 part of 4,4'-isopropylidene-bis(phenol), or
0.5 part of 4-hydroxyacetophenone.

EXAMPLE 7

Scoured cotton fabric is padded in the pad-steam process with a dye liquor containing:
40 parts of the liquid commercial form of the dye Vat Green 3 (Colour Index No. 69500) and
960 parts of water;
the fabric is dried and subsequently padded with a liquor of the following composition:
60 parts of concentrated NaOH 36°Be'
50 parts of sodium dithionite,
1 part of N,N',N,N'-tetramethylguanidine, and
889 parts of water.
The fabric is steamed for about 30 seconds at 100°, and is then further treated in a manner identical to that described in Example 1. The resulting green dyeing is more deeply coloured than a comparative dyeing made without the addition of N,N',N,N'-tetramethylguanidine.

There are likewise obtained green dyeings more deeply coloured than the dyeing made without the vatting accelerator by using, instead of 1.0 part of N,N',N,N'-tetramethylguanidine, any one of the following products in the amount given:
0.5 part of the sodium salt of diethyldithiocarbamate,
1.5 parts of a 30% liquid dispersion of 2,5-di-tert-butylhydroquinone, or
1.0 part of a 50% liquid vatting accelerator of the following composition:
20 parts of 4,4'-isopropylidene-bis(phenol),
15 parts of 2-benzyl-4-chlorophenol,
15 parts of N-(hydroxyethyl)-ethylenediamine,
5 parts of concentrated NaOH 36°Be', and
45 parts of butyl diglycol.

What is claimed is:

1. A dyestuff composition containing an effective amount of a vat dye or a sulfur dye and 0.1 to 2.0 weight %, relative to the weight of dye, of a vatting accelerator of the formula

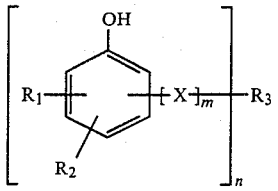

wherein $R_1$ and $R_2$ independently of one another are $C_1$–$C_{12}$-alkyl, $C_3$–$C_{12}$-alkenyl, hydroxymethyl, hydrogen, halogen, hydroxy, $C_1$–$C_4$-alkoxy, phenyl, substituted phenyl, phenethyl, or benzyloxy; m is 0 or 1; $R_3$ is

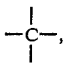

—S—, —S—S—, —O—, —CH=CH—, or $>CR_4R_4$, wherein each $R_4$ independently of the other is hydrogen or $C_1$–$C_4$-alkyl; n is a number from 2 to 4; and X is $—(CH_2)_2—COO—CH_2—$.

2. The dyestuff composition of claim 1, wherein the vatting accelerator content is 0.5 to 10 weight %.

3. The dyestuff composition of claim 1, wherein the vatting accelerator is of the formula

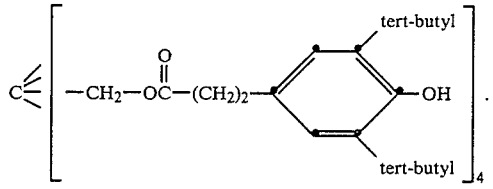

4. The dyestuff composition of claim 1, wherein $R_1$ and $R_2$ are selected to sterically hinder the phenolic hydroxyl group.

5. The dyestuff composition of claim 4, wherein at best one of $R_1$ and $R_2$ is a tert-alkyl group, ortho to the phenolic hydroxyl group.

6. A dye bath which contains 0.01–5 g/l of a vatting accelerator of claim 1.

7. A printing paste which contains 0.01–5 g/kg of a vatting accelerator of claim 1.

* * * * *

UNITED STATES PATENT AND TRADEMARK OFFICE

CERTIFICATE OF CORRECTION

PATENT NO. : 4,519,805

DATED : May 28, 1985

INVENTOR(S) : Zdenek Koci

It is certified that error appears in the above-identified patent and that said Letters Patent is hereby corrected as shown below:

Column 12, Claim 1, Line 2, should read --
and 0.1 to 20 --.

Signed and Sealed this

Twenty-first Day of October, 1986

[SEAL]

*Attest:*

DONALD J. QUIGG

*Attesting Officer*

*Commissioner of Patents and Trademarks*